US012529386B2

(12) United States Patent
Cho

(10) Patent No.: US 12,529,386 B2
(45) Date of Patent: Jan. 20, 2026

(54) VACUUM EJECTOR PUMP

(71) Applicant: VTEC CO., LTD., Busan (KR)

(72) Inventor: Ho-Young Cho, Seoul (KR)

(73) Assignee: VTEC CO., LTD., Busan (KR)

( * ) Notice: Subject to any disclaimer, the term of this patent is extended or adjusted under 35 U.S.C. 154(b) by 0 days.

(21) Appl. No.: 19/076,280

(22) Filed: Mar. 11, 2025

(65) Prior Publication Data

US 2025/0314259 A1 Oct. 9, 2025

(30) Foreign Application Priority Data

Apr. 8, 2024 (KR) ..... 10-2024-0047199

(51) Int. Cl.
*F04F 9/00* (2006.01)

(52) U.S. Cl.
CPC ..... *F04F 9/00* (2013.01)

(58) Field of Classification Search
CPC ..... F04F 5/467; F04F 5/22; F04F 5/52; F04F 5/20; F04F 5/54; F16K 15/03–034; F16K 2200/50; F16K 2200/501; F16K 2200/22; F16K 2200/502; Y10T 137/6017; Y10T 137/6011
USPC ..... 417/65
See application file for complete search history.

(56) References Cited

U.S. PATENT DOCUMENTS 4,395,202 A 7/1983 Tell
4,466,778 A 8/1984 Volkmann
4,759,691 A 7/1988 Kroupa
4,790,054 A 12/1988 Nichols
4,880,358 A * 11/1989 Lasto ..... F04F 5/22 417/174
5,169,293 A 12/1992 Yamamoto
5,228,839 A 7/1993 Peterson et al.
5,683,227 A 11/1997 Nagai et al.
6,394,760 B1 5/2002 Tell
6,582,199 B1 6/2003 Volkmann
6,585,695 B1 7/2003 Adair et al.
6,682,313 B1 * 1/2004 Sulmone ..... F04D 9/06 417/199.2
7,438,535 B2 10/2008 Morishima
8,231,358 B2 * 7/2012 Cho ..... F04F 5/22 417/189
11,149,752 B2 10/2021 Cho
(Continued)

FOREIGN PATENT DOCUMENTS

KR 101039470 B1 6/2011
KR 20130102790 A 9/2013

*Primary Examiner* — Mark A Laurenzi
*Assistant Examiner* — Benjamin Doyle
(74) *Attorney, Agent, or Firm* — INNOVATION CAPITAL LAW GROUP, LLP; Vic Lin

(57) ABSTRACT

Provided is a vacuum ejector pump that operates through high-speed compressed air. The ejector pump includes an external 'C'-shaped clip for securely fixing a casing assembled to a nozzle body, an internal fastening groove and protrusion to prevent arbitrary rotation of the casing relative to the body, and a guide groove and protrusion to indicate the assembly orientation of the body and the casing. Additionally, a check valve that is organically coupled to the body is further included. Accordingly, when using the vacuum ejector pump, the entire structure may be maintained in a robust and stable manner. As a result, vacuum leakage may be minimized.

6 Claims, 6 Drawing Sheets

(56) References Cited

U.S. PATENT DOCUMENTS

| | | | | |
|---|---|---|---|---|
| 2007/0148009 | A1* | 6/2007 | Cho | F04F 5/467<br>417/174 |
| 2011/0123359 | A1* | 5/2011 | Schaaf | F04F 5/467<br>417/174 |
| 2017/0037874 | A1* | 2/2017 | Cho | F04F 5/464 |
| 2019/0168153 | A1* | 6/2019 | Cho | B01D 46/71 |

* cited by examiner

11:14, 15, 16, 17

11: 14, 15, 16, 17

VACUUM EJECTOR PUMP

CROSS-REFERENCE TO RELATED APPLICATION

This application claims priority to Korean Patent Application No. 10-2024-0047199 filed on Apr. 8, 2024 and all the benefits accruing therefrom under 35 U.S.C. § 119, the contents of which are incorporated by reference in their entirety.

BACKGROUND

The present disclosure relates to a vacuum ejector pump, and more particularly, to a vacuum ejector pump that is used to evacuate a predetermined space through compressed air introduced or discharged at a high speed.

A vacuum ejector pump is generally a device used in a vacuum transfer system, including an ejector body that includes a multi-stage nozzle arranged in series, a through-hole defined in a sidewall of the body, and a flexible valve installed inside the through-hole. In particular, a small-sized vacuum ejector pump is directly mounted inside a housing that requires evacuation, wherein a vacuum chamber inside the housing communicates with the through-hole. Additionally, a separate suction device, such as a suction cup or pad, is connected to the vacuum chamber to constitute a vacuum system. During system operation, when the supplied compressed air passes through the ejector body at high speed and is discharged, air inside the vacuum chamber is drawn into the body through the through-hole and discharged together with the compressed air. Accordingly, vacuum and negative pressure (−kPa) are generated in the vacuum chamber and the suction device. When the generated negative pressure falls below a certain level, the through-hole is closed by the valve, allowing the vacuum chamber to maintain its pressure level. The internal negative pressure generated in the suction device during this process is utilized for gripping and transporting objects.

A representative type of such a vacuum ejector pump is disclosed in Korean Patent Publication No. 10-0393434 (U.S. Pat. No. 6,394,760) and Korean Patent Publication No. 10-0629994 (U.S. Pat. No. 8,231,358). The former discloses a structure in which multiple nozzles of the same shape are assembled in parallel in a single direction, with valve elements installed between each nozzle, while the latter discloses a structure in which each nozzle is assembled using a separate cylindrical member.

The disclosed devices are currently in actual use at vacuum transfer work sites. However, these devices all have several issues, including low productivity due to the complexity of assembling each component, as well as structural weaknesses that make them unstable, allowing individual parts to be arbitrarily separated or rotated during installation and use. This results in reduced airtightness, making vacuum leakage more likely to occur. Furthermore, the latter has additional drawbacks, such as an increased number of components, making production and assembly more cumbersome and uneconomical.

PRIOR ART DOCUMENT

Korean Patent No. 10-0393434
Korean Patent No. 10-0629994
Korean Patent No. 10-1039470
Korean Patent No. 10-1685998

SUMMARY

The present disclosure provides an improved invention proposed to address the issues of conventional vacuum ejector pumps, particularly those disclosed in Korean Patent No. 10-0629994. The objective of the present invention is to provide a vacuum ejector pump that may be easily assembled and manufactured, remains robust and stable during installation and use, and further minimizes vacuum leakage.

In an embodiment of the inventive concept, a vacuum ejector pump, which operates through compressed air introduced or discharged at a high speed to generate a negative pressure in an outer surrounding space includes: a body including: a frame having a structure in which an air inlet pipe, discs, and an outlet pipe are sequentially spaced apart and integrally connected by a spacer; and nozzles mounted by passing through centers of the discs; a cylindrical casing, which has a sidewall through-hole defined in a position corresponding to a flexible check valve mounted on a portion of the spacer and configured to accommodate the body in a close contact manner so as to provide chambers in sections of each spacer, respectively; and a C-shaped clip fitted into an outer circumferential surface of the inlet pipe of the body and having one end that presses the other end of the casing supported by a hook protrusion of the outlet pipe toward the inlet pipe so that the casing is fixed in the close contact manner; wherein the check valve is provided with a ring-shaped fixing part and a flap valve part, which are integrated with each other, wherein the ring-shaped fixing part is fitted into and fixed to an annular groove defined in an outer circumferential surface of each of the discs, and the flap valve part extends from the fixing part and is configured to open and close the through-hole by an air pressure, wherein the valve part is provided in a pair at left and right sides and has a groove or hole defined at a boundary with the fixing part to facilitate movement of the valve part.

In an embodiment, a coupling groove may be defined in the outer circumferential surface of each of the discs, and a coupling protrusion corresponding to the coupling groove is provided on an inner surface of the casing, so that during assembly of the body and the casing, the coupling protrusion is fitted into the coupling groove to prevent rotation of the casing.

In an embodiment, an assembly guide groove and a guide protrusion may be provided at an end of the casing and the hook protrusion of the outlet pipe, which are engaged with each other, so that correct orientation setting, in which the coupling protrusion and the coupling groove are coupled to correspond to each other, is confirmed from the outside by a naked eye.

BRIEF DESCRIPTION OF THE DRAWINGS

Exemplary embodiments can be understood in more detail from the following description taken in conjunction with the accompanying drawings, in which.

DETAILED DESCRIPTION OF EMBODIMENTS

Figure 1:
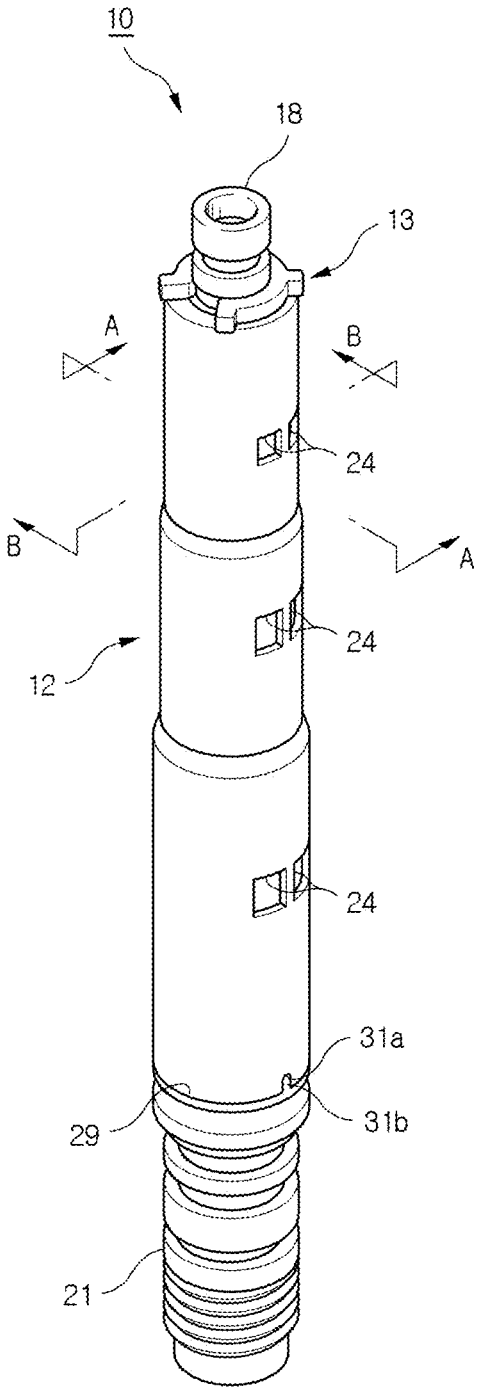
FIG. 1 is an external view of a vacuum ejector pump according to the present invention.
Figure 2:
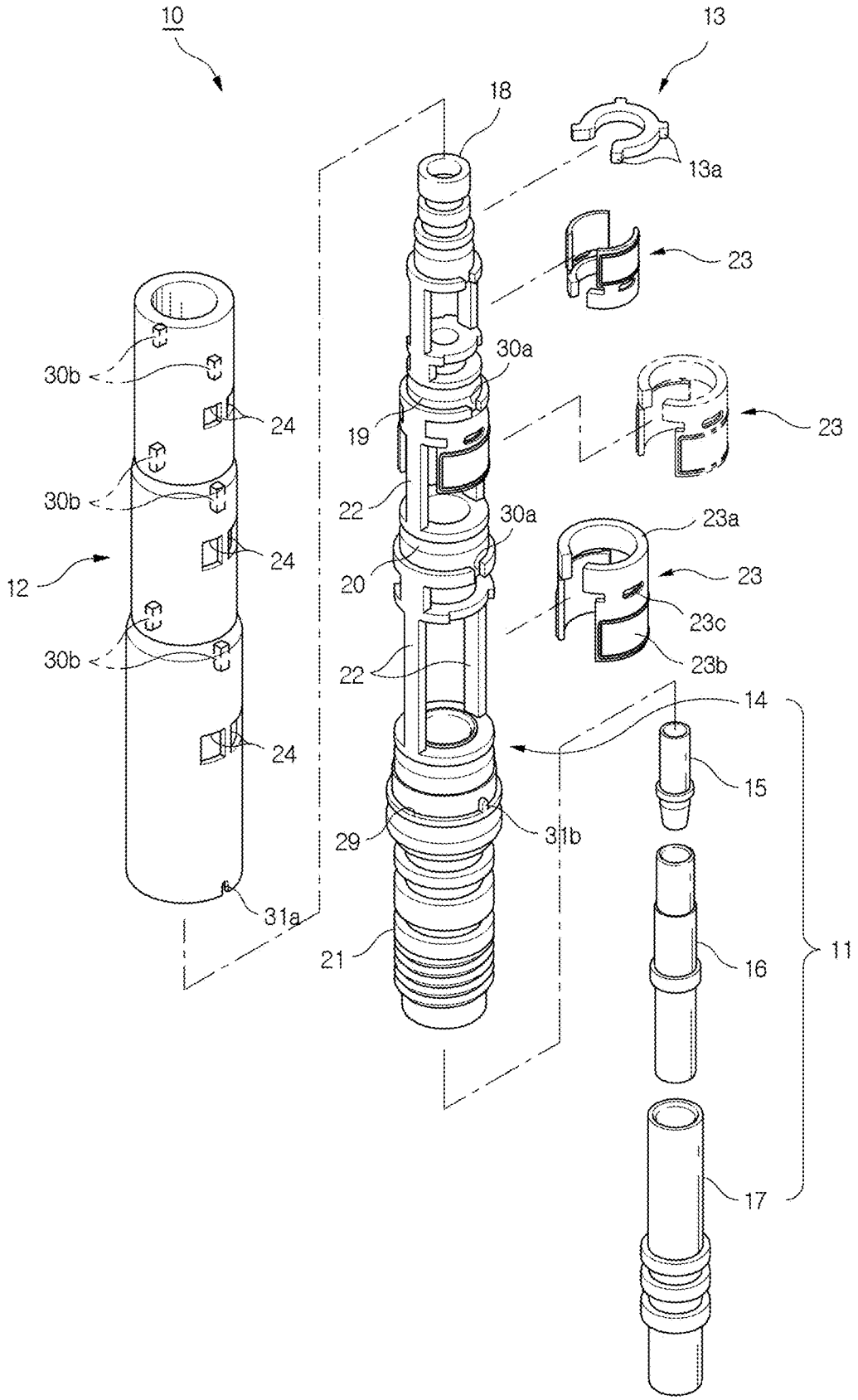
FIG. 2 is an exploded view of FIG. 1.
Figure 3:
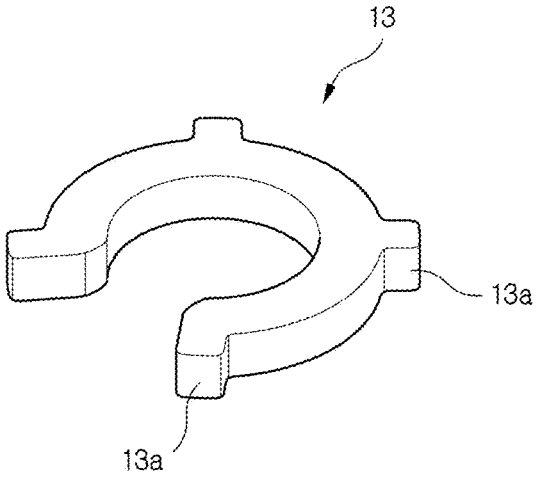
FIG. 3 is an enlarged view of a 'clip' applied in FIG. 2.
Figure 4:
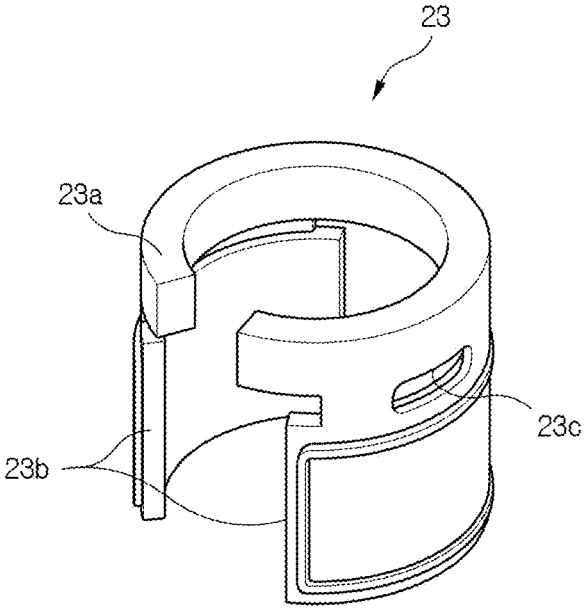
FIG. 4 is an enlarged view of a 'valve' applied in FIG. 2.
Figure 5:
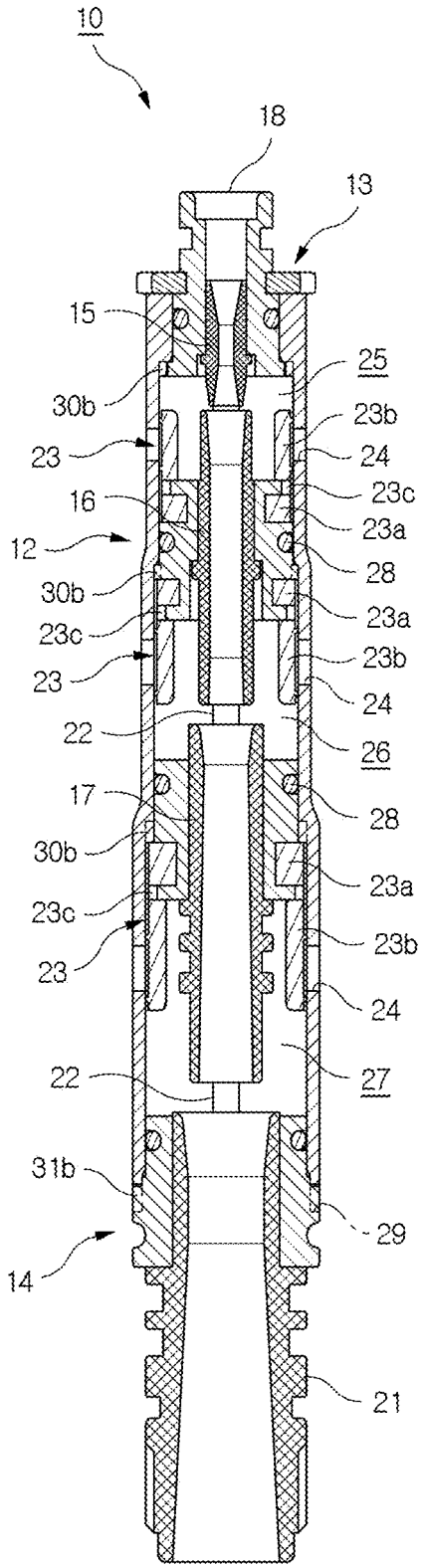
FIG. 5 is a cross-sectional view taken along line A-A of FIG. 1.
Figure 6:
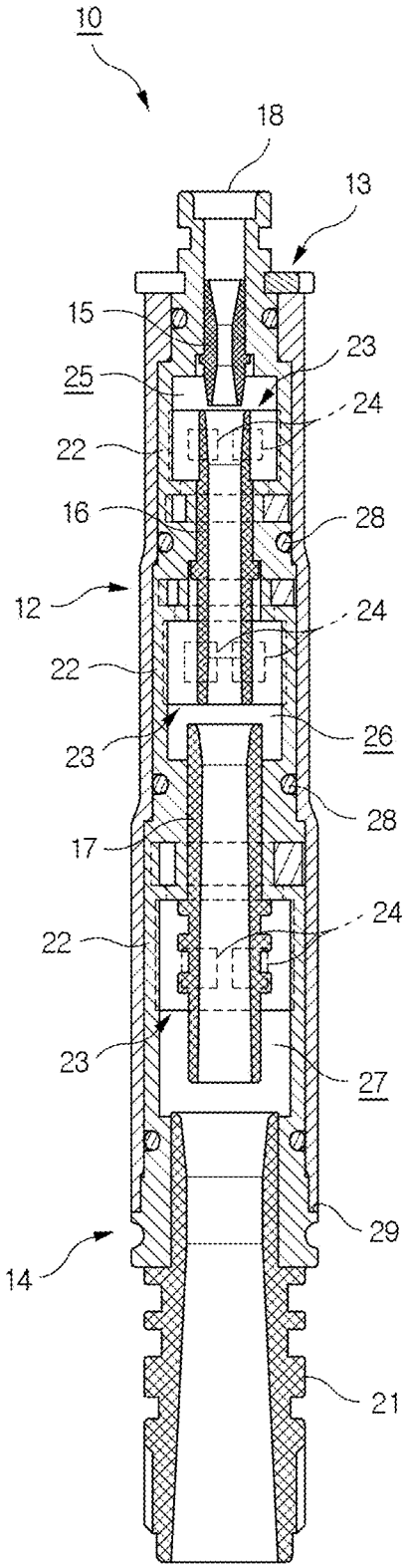
FIG. 6 is a cross-sectional view taken along line B-B of FIG. 1.

The features and operational effects of a vacuum ejector pump (hereinafter referred to as the 'ejector pump') according to the present invention, whether described above or not, will become more apparent through the following description of embodiments with reference to the accompanying drawings. In the drawings, reference numeral 10 denotes an ejector pump according to the present invention.

Referring to FIGS. 1 to 6, the ejector pump 10 of the present invention is based on a vacuum pump and operates through compressed air that flows into or is discharged at high speed, generating negative pressure in an outer surrounding space. The ejector pump 10 may include a nozzle body 11, a cylindrical casing 12 that accommodates the body 11, and a clip 13 that secures the casing 12 to the body 11.

The body 11 may include a frame 14 and nozzles 15, 16, and 17. Here, the frame 14 may be provided as an integral structure with an air inlet pipe 18, circular discs 19 and 20, and an air outlet pipe 21, which are sequentially spaced apart and connected by spacers 22. The nozzles 15, 16, and 17 may be mounted by passing through centers of the discs 19 and 20. In this embodiment, two discs 19 and 20 may be provided, however, there may be one or three or more discs may be provided in other embodiment that is not shown.

The nozzles 15, 16, and 17 may be fitted into the centers of discs 19 and 20 and mounted, being arranged in series with spacing to provide a single nozzle set. In another embodiment that is not shown, a plurality of nozzle sets may be provided in parallel by providing a plurality of mounting holes in each of discs 19 and 20.

The spacer 22 may be provided as a pair facing each other on and edge of each of the discs 19 and 20. More specifically, each spacer 22 may have a rounded outer surface and a flat inner surface. Particularly, since the spacer 22 has a rounded outer surface, it may be in close contact with an inner surface of the cylindrical casing 12. A flexible check valve 23 may be disposed on an open portion of the frame 14 defined by the spacers 22.

More specifically, the check valve 23 may be provided with a ring-shaped fixing part 23*a* and a flap valve part 23*b*, which are integrated with each other, wherein the ring-shaped fixing part 23*a* is fitted into an annular groove (not shown) defined in an outer circumferential surface of each of the discs 19 and 20 and fixed while surrounding the annular groove, and the flap valve part 23*b* extends from the fixing part 23*a*, moves by air pressure, and opens or closes a sidewall through-hole 24 of the casing 12, which will be described later. In this embodiment, the valve part 23*b* may be provided as a pair at the left and right sides, and a groove or hole 23*c* may be defined at a boundary between the fixing part 23*a* and each valve part 23*b* to facilitate movement of the valve part 23*b*.

The check valve 23 may be made of a flexible material selected from natural rubber, synthetic rubber, or urethane rubber.

The casing 12 may have the sidewall through-hole 24 defined in a position corresponding to each valve part 23*a* of the check valve 23. The casing 12 may accommodate the nozzle body 11 in close contact with an inner wall thereof. More specifically, each component of the body 11, excluding the nozzles 15, 16, and 17, and the check valve 23 may be in close contact with the inner surface of the casing 12. Accordingly, chambers 25, 26, and 27 may be provided in sections of each spacer 22 of the body 11. Here, each chamber 25, 26, and 27 may communicate with one another through the nozzles 15, 16, and 17 mounted on the discs 19 and 20 and may also be in fluid communication with the exterior or the surrounding space through the through-holes 24. Here, each through-hole 24 may be controlled to open and close by the flexible valve part 23*b* of the check valve 23, which operates by air pressure.

For example, in a "one-to-one" correspondence between the valve part 23*b* and the through-hole 24, the valve part 23*b* may become stuck in the through-hole 24 due to its size, preventing it from returning to its original position. Accordingly, in this embodiment, a "many-to-one" correspondence may be established between the through-holes 24 and each valve part 23*b*, meaning that a single valve part 23*b* may simultaneously correspond to at least two adjacent through-holes 24. This configuration may effectively resolve the issue of the valve part 23*b* getting stuck in the through-hole 24 by reducing the size of each through-hole 24.

In the drawings, reference numeral 28 denotes an O-ring gasket that is provided at the edges of discs 19 and 20 and in contact with the inner surface of the casing 12 to block unnecessary air movement between chambers 25, 26, and 27.

The ejector pump 10 may be assembled by mounting the check valve 23 to the body 11 and then inserting the body 11 into the casing 12. To facilitate the smooth insertion of the body 11 into the casing 12, the casing 12 may preferably have a progressively expanding inner diameter with a stepped structure. Here, one end of the casing 12 may accommodate an end of the air outlet pipe 21 while being supported by a hook protrusion 29 of the air outlet pipe 21.

However, this structure may not be sufficient to securely maintain the casing 12. In practice, when the ejector pump 10 is forcibly secured to a structure, the casing 12 may be exposed to significant torsion and torque, making it susceptible to deformation. As a result, the device may fail to fully demonstrate its vacuum performance. Accordingly, a means for securely fixing and maintaining the casing 12 may be required.

First, in the present invention, the clip 13 may be provided to securely fix the casing 12 to the body 11. The clip 13 may have an approximately "C" shape and be fitted into an outer circumferential surface of the air inlet pipe 18 of the body 11. In this configuration, since one end of the casing 12 is supported by the hook protrusion 29 of the outlet pipe 21, the other end of the casing 12 may be pressed and in close contact with the inlet pipe 18 by the clip 13, thereby being securely fixed. A plurality of protrusions 13*a* may be provided on both ends and on an outer circumferential surface of the clip 13 to facilitate assembling and disassembling.

Next, coupling grooves 30*a* may be defined in the outer circumferential surface of each of the discs 19 and 20, while coupling protrusions 30*b* corresponding to the coupling grooves 30*a* may be provided on the inner surface of the casing 12. Accordingly, during assembly, the coupling protrusions 30*b* may be fitted into the coupling grooves 30*a*, ensuring that the casing 12 is securely coupled to the body 11 without unintended rotation.

However, since the coupling protrusions 30*b* are not externally visible, aligning the coupling grooves 30*a* with the corresponding coupling protrusions 30*b* during the assembly of the casing 12 and the body 11 may not be easy. To address this, in the present embodiment, an assembly guide groove 31*a* and a guide protrusion 31*b* are provided in an end of the casing 12 and the hook protrusion 29 of the outlet pipe 21, which are engaged with each other, so that correct the orientation setting, in which the coupling-protrusion 30*b* and the coupling groove 30*a* are coupled to correspond to each other, is confirmed from the outside by a naked eye. More specifically, during assembly, when the casing 12 is inserted into the body 11 while ensuring that the guide groove 31*a* corresponds with the guide protrusion 31*b*, the coupling groove 30*a* and the coupling protrusion 30*b* may be properly engaged in the correct position.

Figure 7:
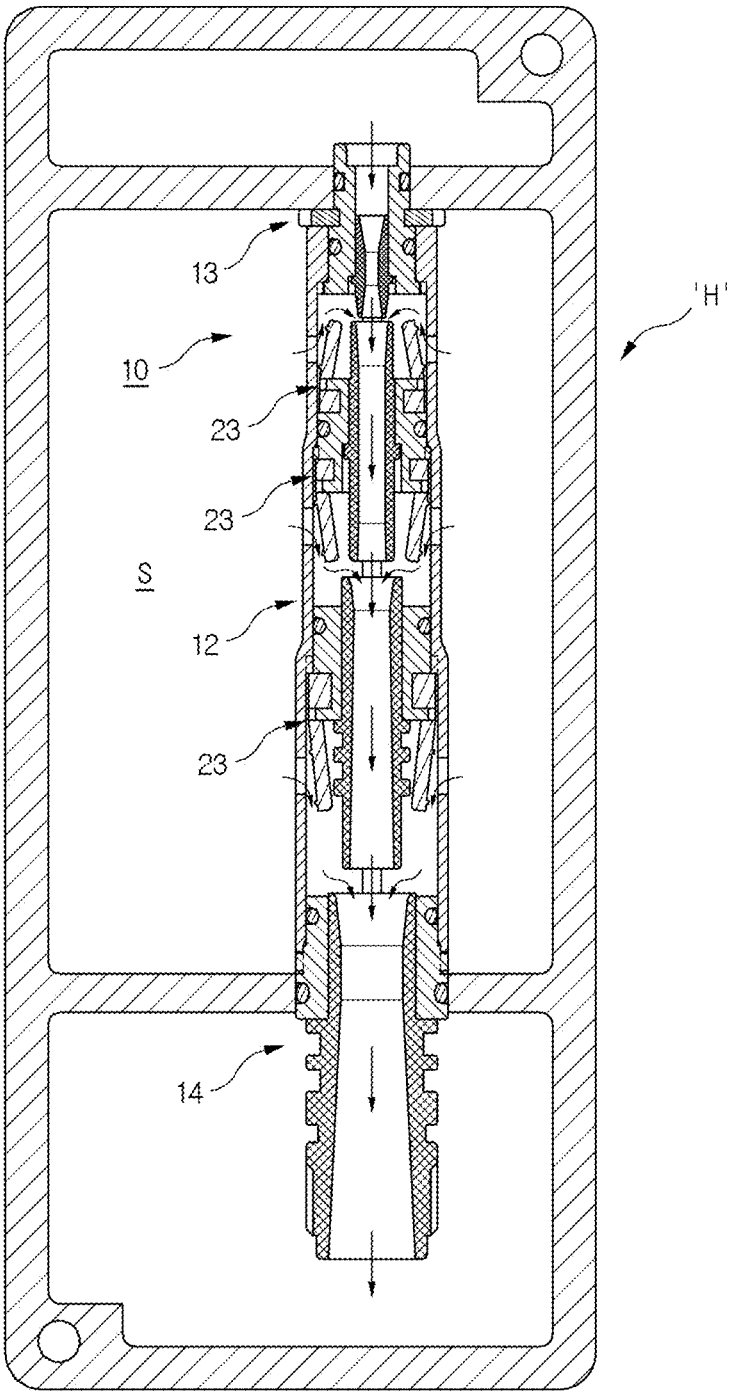
FIG. 7 is an exemplary view illustrating a usage state of the vacuum ejector pump according to the present invention.

Referring to FIG. 7, the ejector pump 10 according to the present invention is illustrated as being accommodated within a separate device housing H. The ejector pump 10 may pass through the surrounding space S and mounted on both sidewalls of the housing H. In this case, the surrounding space S may be in fluid communication with the inner chambers 25, 26, and 27 of the ejector pumps 10 through the through-holes 24.

In this state, the compressed air supplied into the ejector pump 10 through the air inlet pipe 18 may pass through the nozzles 15, 16, and 17 at high speed and be discharged to the outside through the outlet pipe 21. Here, the air in the surrounding space S may be drawn into the chambers 25, 26, and 27 through the through-holes 24 and the opened check valve 23 of the ejector pump 10 and may be discharged together with the compressed air (see arrows). Through this exhaust and discharge action, vacuum and negative pressure may be generated in the surrounding space S.

As the vacuum and negative pressure (−kPa) in the surrounding space S continue to drop below an internal pressure of the ejector pump 10, the check valve 23 may return to its original position, closing all through-holes 24, thereby maintaining the pressure level in the surrounding space S. The vacuum and negative pressure generated and maintained in this manner may be effectively utilized in a vacuum transport system for gripping and transferring target objects to designated positions.

The vacuum ejector pump according to the present invention is based on a vacuum pump that includes the assembled nozzle body and the casing. By optimally configuring the 'C'-shaped clip, fastening grooves and protrusions, guide grooves and protrusions, and the check valve structure, the casing and the entire device may remain robust and stable during installation and use, ultimately minimizing vacuum leakage.

As described above, while the embodiments of the present disclosure have been described with reference to the specific embodiments, it will be apparent to those skilled in the art that various changes and modifications may be made without departing from the spirit and scope of the invention as defined in the following claims.

What is claimed is:

1. A vacuum ejector pump, which operates through compressed air introduced or discharged at a high speed to generate a negative pressure in an outer surrounding space, the vacuum ejector pump comprising:

a body (11) comprising:

a frame (14) having a structure in which an air inlet pipe (18), discs (19) and (20), and an outlet pipe (21) are sequentially spaced apart and integrally connected by a spacer (22); and nozzles (15, 16, and 17) mounted by passing through centers of the discs (19 and 20);

a cylindrical casing (12), which has a sidewall through-hole (24) defined in a position corresponding to a flexible check valve (23) mounted on a portion of the spacer (22) and configured to accommodate the body (11) in a close contact manner so as to provide chambers (25, 26, and 27) in sections of each spacer (22), respectively; and a C-shaped clip (13) fitted into an outer circumferential surface of the inlet pipe (18) of the body (11) and having one end that presses the other end of the casing (12) supported by a hook protrusion (29) of the outlet pipe (21) toward the inlet pipe 18 so that the casing (12) is fixed in the close contact manner;

wherein the check valve (23) is provided with a ring-shaped fixing part (23*a*) and a flap valve part (23*b*), which are integrated with each other, wherein the ring-shaped fixing part (23*a*) is fitted into and fixed to an annular groove defined in an outer circumferential surface of each of the discs (19 and 20), and the flap valve part (23*b*) extends from the fixing part (23*a*) and is configured to open and close the through-hole (24) by an air pressure, wherein the valve part (23*b*) is provided in a pair at left and right sides and has a groove or hole (23*c*) defined at a boundary with the fixing part (23*a*) to facilitate movement of the valve part (23*b*).

2. The vacuum ejector pump according to claim 1, wherein a plurality of protrusions (13*a*) are provided at both ends and on an outer circumferential surface of the clip (13) to facilitate disassembling and assembling.

3. The vacuum ejector pump according to claim 1, wherein a coupling groove (30*a*) is defined in the outer circumferential surface of each of the discs (19 and 20), and a coupling protrusion (30*b*) corresponding to the coupling groove (30*a*) is provided on an inner surface of the casing (12), so that during assembly of the body (11) and the casing (12), the coupling protrusion (30*b*) is fitted into the coupling groove (30*a*) to prevent rotation of the casing (12).

4. The vacuum ejector pump according to claim 3, wherein an assembly guide groove (31*a*) and a guide protrusion (31*b*) are provided in an end of the casing (12) and the hook protrusion (29) of the outlet pipe (21), which are engaged with each other, so that correct orientation setting, in which the coupling-protrusion (30*b*) and the coupling groove (30*a*) are coupled to correspond to each other, is confirmed from the outside by a naked eye.

5. The vacuum ejector pump according to claim 1, wherein the spacer (22) is disposed on an edge of each of the discs (19 and 20) and is provided in a pair facing each other.

6. The vacuum ejector pump according to claim 1, wherein the casing (12) and the check valve (23) are configured so that a "many-to-one" correspondence is established between the through-holes (24) and the valve part (23*b*), i.e., a single valve part (23*b*) simultaneously corresponds to at least two adjacent through-holes (24).

* * * * *